US005088165A

United States Patent [19]

Minasy et al.

[11] Patent Number: 5,088,165

[45] Date of Patent: Feb. 18, 1992

[54] THEFT DETERRENT FASTENER AND FASTENER ASSEMBLY

[75] Inventors: Arthur J. Minasy, Woodbury; Thomas A. Nicolette, Fort Salonga, both of N.Y.

[73] Assignee: Knogo Corporation, Hauppauge, N.Y.

[21] Appl. No.: 573,688

[22] Filed: Aug. 28, 1990

[51] Int. Cl.[5] ..... A44B 9/00

[52] U.S. Cl. ..... 24/704.1; 24/711.4; 70/57.1

[58] Field of Search ..... 24/704.1, 711.4; 70/57.1; 340/572; 411/13; 116/203, 212

[56] References Cited

U.S. PATENT DOCUMENTS

| | | | |
|---|---|---|---|
| 3,500,373 | 3/1970 | Minasy . | |
| 4,156,302 | 5/1979 | Van Niel | 24/707.5 |
| 4,187,509 | 2/1980 | Weiner . | |
| 4,483,049 | 11/1984 | Gustavsson et al. . | |
| 4,531,264 | 7/1985 | Minasy . | |
| 4,590,461 | 5/1986 | Cooper . | |
| 4,649,397 | 3/1987 | Heaton et al. . | |
| 4,944,075 | 7/1990 | Hogan | 70/57.1 X |

FOREIGN PATENT DOCUMENTS 3148730 7/1983 Fed. Rep. of Germany ..... 411/13

OTHER PUBLICATIONS

The Colortag Standard, Colortag, Inc., 3 pages.
"Your electronic security now doubly effective, with CombiClip ®", Kleurklem Benelux B.V., 1 page.
Colortag Brochure, 15 pages.
The Easiest Way to Make Money . . . Is to Stop Losing—, Colortag Ltd., 4 pages.
Colortag ® Bulletin, Oct. 1989, 4 pages.
The Best and Most Profitable Way to Prevent Shoplifting in the Clothing Business, Colortag Inc., 4 pages.

*Primary Examiner*—James R. Brittain
*Attorney, Agent, or Firm*—Fitzpatrick, Cella, Harper & Scinto

[57] ABSTRACT

A fastener and fastener assembly characterized by a pin with an expansive molded plastic head of concave configuration and a frangible membrane sealed to the head to enclose a hollow space for containing an undesirable fluid such as a dye, so that when prying forces are applied to bend the head, the membrane is stressed and shatters to release the dye.

16 Claims, 5 Drawing Sheets

THEFT DETERRENT FASTENER AND FASTENER ASSEMBLY

BACKGROUND OF THE INVENTION

1. Field of the Invention

This invention relates to fasteners and assemblies containing same and more particularly it concerns fasteners and assemblies which discourage the unauthorized removal of elements from sheet-like objects such as an article of merchandise.

2. Description of the Prior Art

Devices which spill a disfiguring dye or release an undesirable substance in response to unauthorized attempts to remove them from merchandise are known.

U.S. Pat. Nos. 4,483,049 and No. 4,649,397 show prior art fasteners and assemblies over which the subject invention is an improvement. Both of these patents show a housing formed of two halves which are hinged together at one end and which close upon each other along the edge portion of an article. Pins extending from one half penetrate the article; and their points are received in the other half to hold the halves tightly to the article when they are closed on each other. A special locking mechanism, separate from the pins, holds the halves closed on each other until they are released by a special tool. Frangible ampoules or containers are arranged in at least one housing half and these ampoules or containers contain a dye, an ill-smelling gas or some other fluid which produces undesirable effects when released. According to the patents, attempts to remove the housing by forcing its halves apart while they are locked will cause them to bend; and because of the stiffness of the ampoules or containers they will break and release the fluid contained therein.

There is also on the market a fastener pin known as "COLOR CAP", which is marketed by Antonson Security A/S of Karslunde, Denmark. The "COLOR CAP" fastener comprises a pin fastener and a hollow outer shield. The pin fastener has an enlarged plastic head with a thin peripheral flange. The outer shield surrounds and extends over the plastic head and forms a hollow space around the head. A liquid dye is provided in the hollow space and is maintained thereby by a seal between the flange on the plastic head and the outer shield.

The fastener assemblies of each of these prior art arrangements are complicated and expensive to manufacture. Specifically, the assemblies shown in U.S. Pat. Nos. 4,483,049 and No. 4,649,397 require dye containing ampoules or containers which are separate from and must be assembled into the housings. Moreover, because the ampoule or container is separate from the housing the amount of bending of the housing that may be needed to break the ampoule or container is difficult to control. The "COLOR CAP" fastener does integrate a dye container into a housing but the housing and pin are not solidly interconnected except through the thin flange. Also, the region through which the dye or other substance must exit is confined to the thin peripheral flange region.

SUMMARY OF THE INVENTION

The present invention overcomes these problems of the prior art and provides a pin type fastener and fastening assembly which is inexpensive to manufacture and which is reliable in operation. Moreover, with the present invention, the pin and the outer housing are solidly connected together; and when undue stress is applied to the head a large opening develops to effect immediate release of all the dye or other substance contained in the device.

According to the present invention there is provided a novel fastener for attaching an element to a sheet-like object in a manner which will discourage unauthorized removal of the element. This novel fastener comprises an expansive head, a pin, a fluid substance capable of producing an undesirable effect upon release from containment and a frangible membrane. The expansive head is made of molded plastic material and is formed in a dished configuration with an outer peripheral skirt surrounding a central axial hub. The skirt is spaced from the but to form a hollow region therebetween. The head is of one-piece construction with the skirt and the hub joined to each other.

The pin extends through the hub along a line substantially perpendicular to a plane defined by the edge of the skirt and it extends from the skirt edge side of the head. The fluid substance is contained in the hollow region and the frangible membrane extends between and is sealed to both the skirt and the hub to contain the fluid substance.

DETAILED DESCRIPTION OF THE PREFERRED EMBODIMENTS

Figure 1:
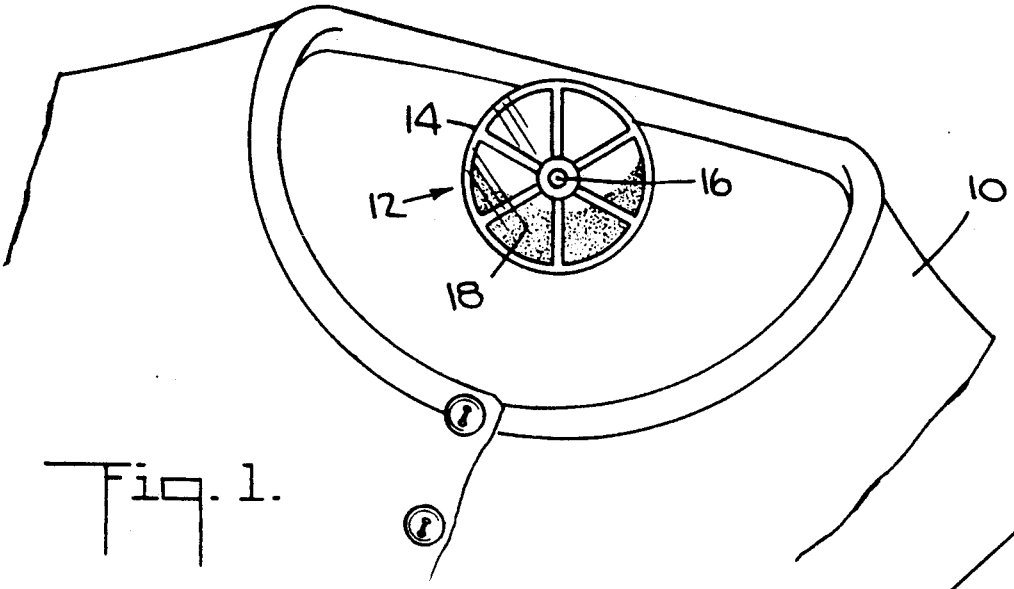
FIG. 1 is a fragmentary perspective view of a garment to which a fastener according to the present invention is attached.

As shown in FIG. 1 a garment 10, such as a shirt, has attached thereto a fastener 12. The fastener comprises an expansive outer head 14 of circular shape and a central pin 16. The outer head 14 is hollow and contains a liquid dye 18 which is capable of permanently staining the garment 10.

Figure 2:
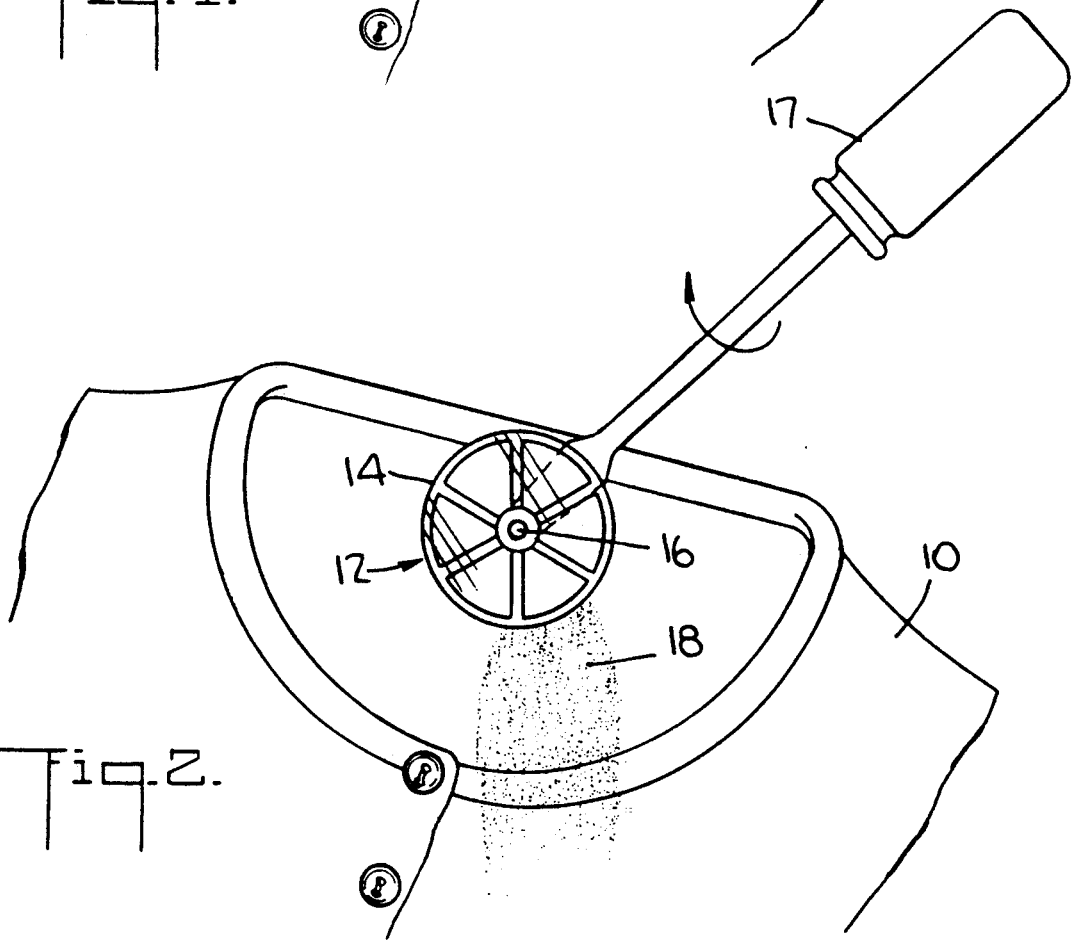
FIG. 2 is a view similar to FIG. 1, showing the result of an attempt to remove the fastener in an unauthorized manner.

Should an attempt be made to remove the fastener 12 from the garment 10 in an unauthorized manner, such as prying it off with a screwdriver 17, as shown in FIG. 2, the fastener head 14 will break and allow the dye 18 to spill onto the garment, thereby rendering it unfit for use.

Figure 3:
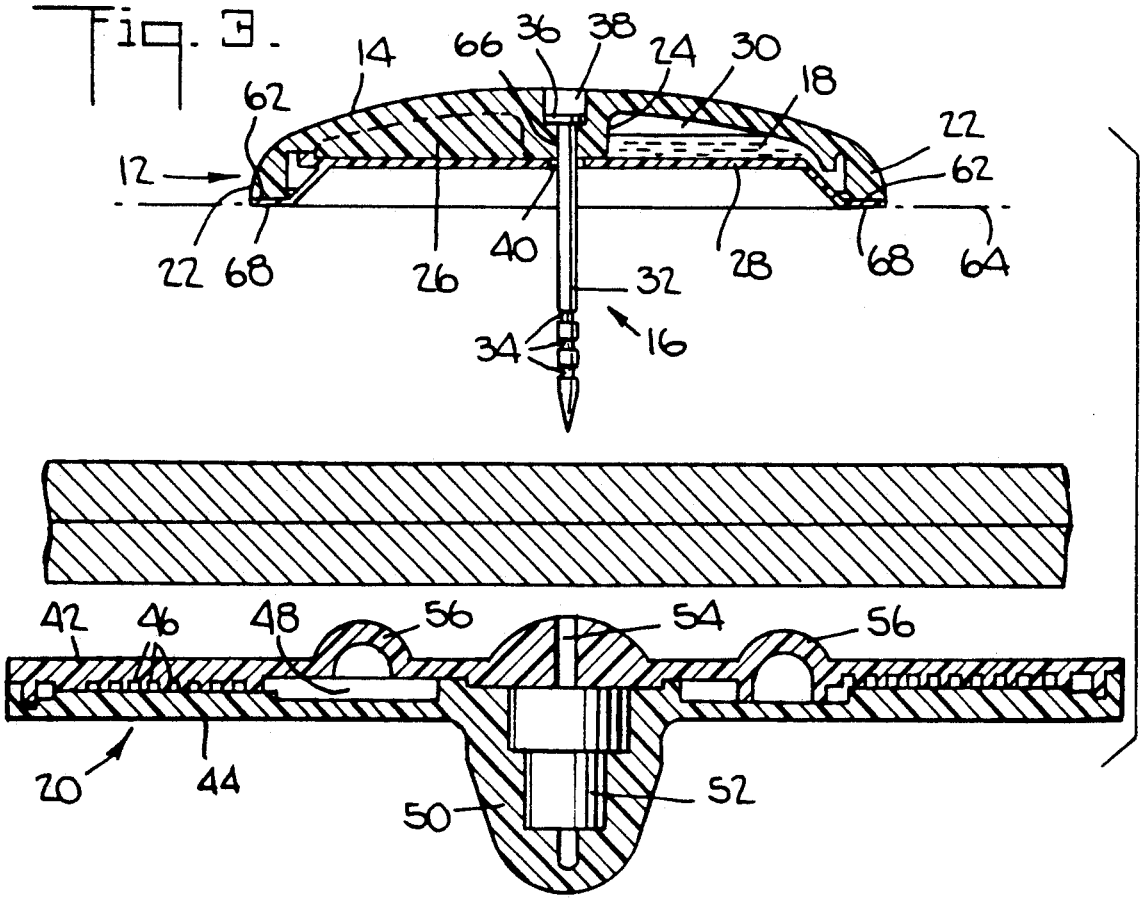
FIG. 3 is an exploded section view of the fastener and garment of FIG. 1 and a target wafer which is attached to the garment by the fastener.

The fastener 12 may be used as part of an assembly which, as shown in FIG. 3, includes a target wafer 20. The target wafer may be of the same construction as shown and described in any of U.S. Pat. No. 4,187,509 No. 4,531,264 and No. 4,590,461; and is held to the garment 10 by the fastener. The target wafer 20 is provided with a special electronic circuit which activates an alarm when it is carried through an interrogation zone or passageway as described in U.S. Pat. No. 3,500,373.

Figure 4:
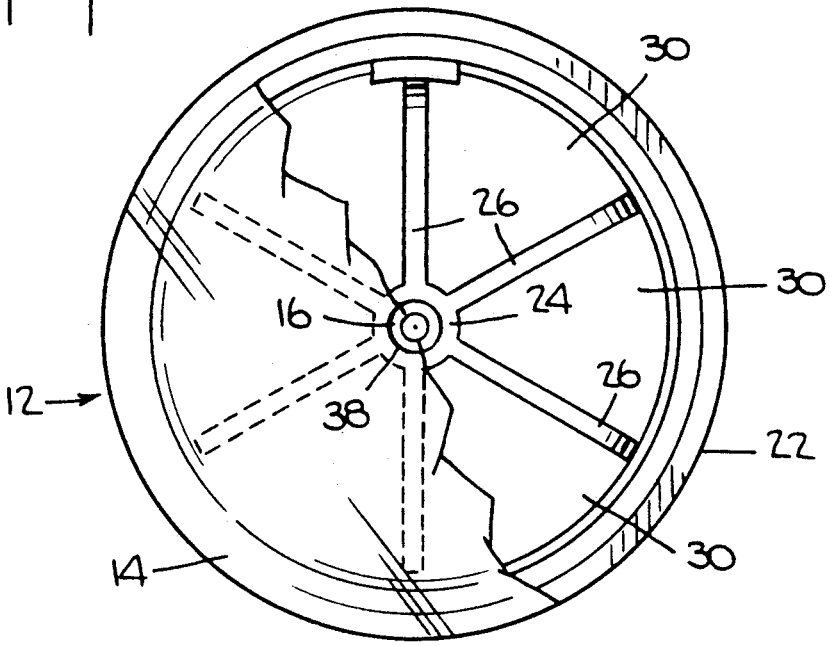
FIG. 4 is a plan view, partially cut away, of the fastener of FIG. 3.

The outer head 14 of the fastener 12, as shown in FIGS. 3 and 4, is of dished or concave configuration and is formed on its concave side with a peripheral skirt 22, a central hub 24 and a plurality of ribs 26 which extend radially from the hub out toward the skirt.

A membrane 28 extends from the hub 24 out to the skirt 22 as shown in FIG. 3 and is secured and sealed to the hub and skirt, preferably by ultrasonic welding. The membrane 28 encloses hollow spaces 30 in which the liquid dye 18 is contained.

The central pin 16 has a pointed shank 32 to enable it to pierce the garment 10. The shank 32 is formed with axially spaced circumferential spaced grooves 34 which ensure that it becomes solidly locked in the target wafer 20. As shown, the pin 16 extends through the hub 24 in a direction generally perpendicular to the plane defined by the skirt 22. The pin 16 is formed, at the end remote from its point, with an enlarged head 36 which fits into a counterbore 38 in the hub 24. The pin 16 extends through a central hole 40 in the membrane 28. The hole 40 is smaller in diameter than the hub 24 so that the membrane rests on and is sealed to the hub 24 and the hole 40.

As shown in FIG. 3 the wafer 20 comprises upper and lower halves 42 and 44 of generally flat configuration and formed with various recesses in their mutually facing surfaces which define cavities 46 and 48 for accommodating an electrical coil and capacitor (not shown) or other circuit or element for use in a electronic theft detection system. The particular theft detection system and associated circuit contained within the target wafer is not important to this invention and any of several well known systems and target circuits may be used. For this reason and for the further reason that the invention can be used without any electrical theft detection system, the details of these components are not described herein.

The lower half 44 of the target wafer 20 has a central projection 50 in which an internal cavity 52 is formed.

The cavity 52 houses a special locking mechanism (not shown) for accommodating and gripping the shank of a pin type fasteners. The locking mechanism may be as described in U.S. Pat. No. 4,531,264 or U.S. Pat. 4,590,461. Again, the particular construction of the locking mechanism is not important to this invention and any of several different types may be used. For these reasons the details of the locking mechanism are not described herein.

The upper half 42 of the target wafer 20 is formed with a central pin opening 54 which extends into the internal cavity 52 for admitting the pin shank 32 into the locking mechanism contained in the cavity. A rounded circular ridge 56 extends around the opening 54 at a distance therefrom. This ridge serves two purposes, first to form an internal cavity for housing a capacitor which is used in the target wafer circuit, and second to form an abutment over which the skirt 22 of the fastener head may extend. The overlap of the skirt and ridge serve to restrict access to the pin shank 32 and thus make it difficult to apply a cutting tool to sever the pin.

As can be seen from FIG. 3, the target wafer 20 is attached to the garment 10 by forcing the pointed end of the pin shank 32 through the garment and into the opening 54 in the target wafer 20 where it becomes held by the locking mechanism (not shown) in the cavity 52.

Figure 5:
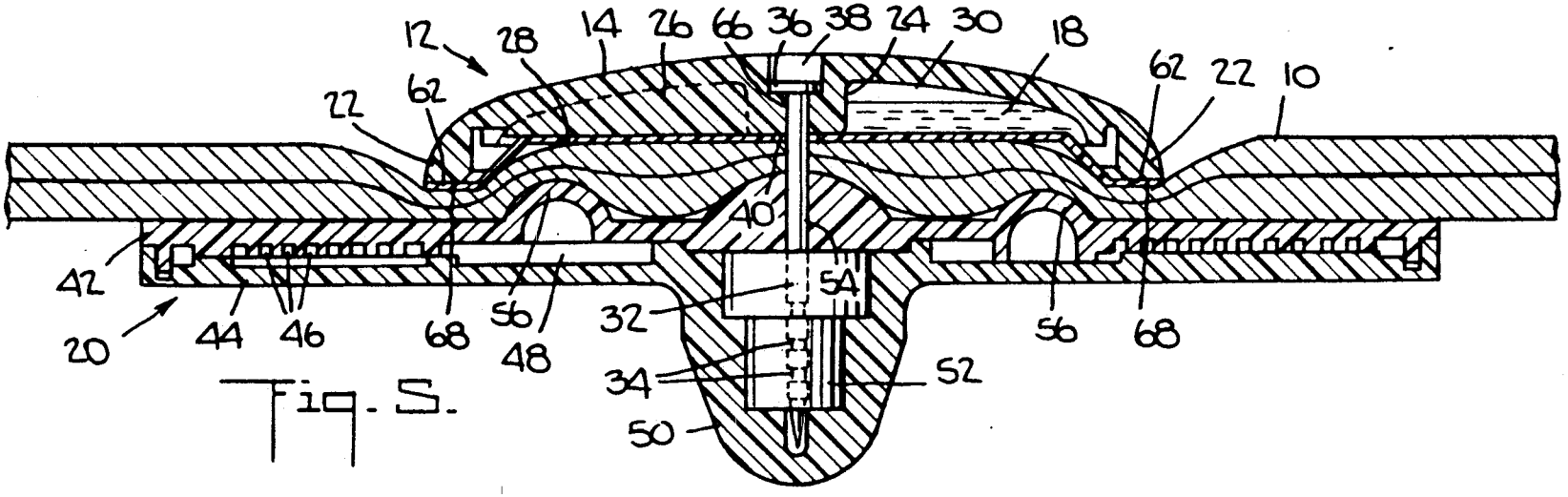
FIG. 5 is an enlarged view similar to FIG. 3 but showing the fastener, garment and target wafer in fully assembled condition.

The fastened condition of the target wafer to the garment is shown in FIG. 5. As can be seen, the peripheral skirt 22 of the fastener head presses and bends the garment 10 over the circular ridge 56 to restrict access to the pin shank.

The target wafer 20 and the fastener 12 may be removed from the garment 10 by a special tool (not shown) which applies magnetic forces to the locking mechanism inside the cavity 52 so that it releases the pin shank 32. Such special tool is provided at a checkout station or other authorization point and is under the control of a sales person or other authorized person. These special decoupling tools are well known and the particular construction of such tool will depend on the particular locking mechanism provided in the cavity 52.

Figure 6:
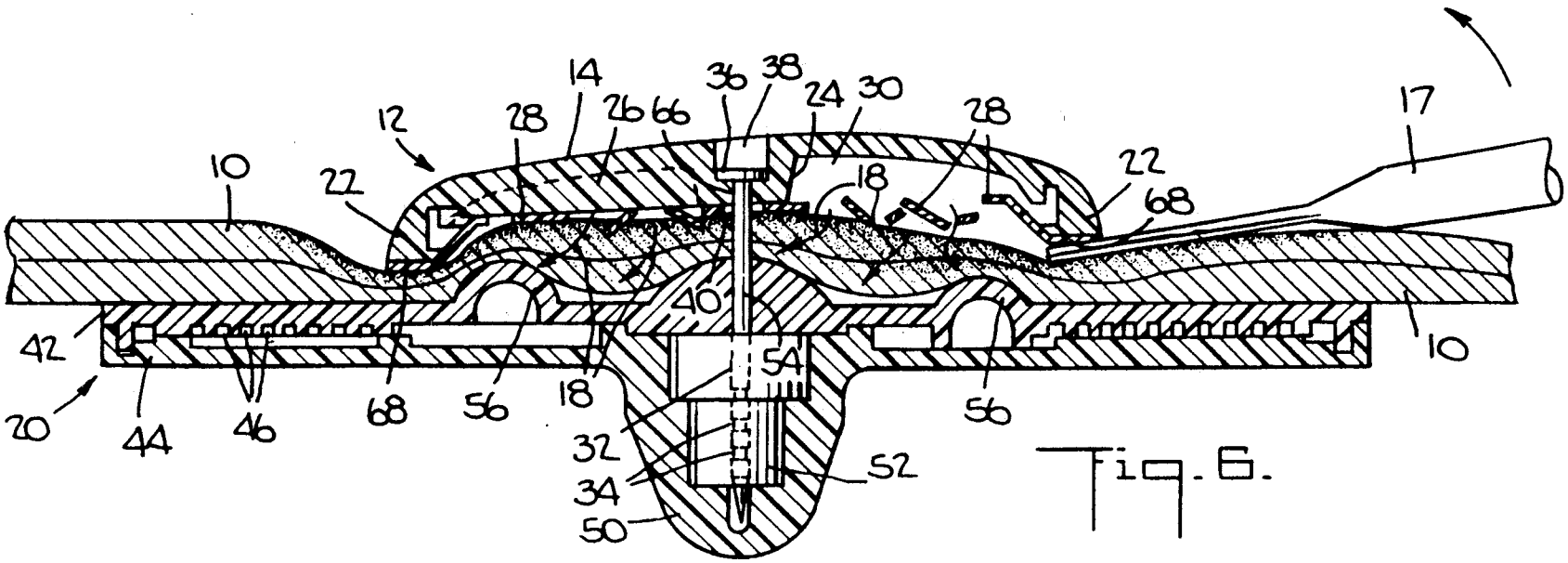
FIG. 6 is a view similar to FIG. 5 but showing the effect of unauthorized attempt to remove the fastener.

When an attempt is made to remove the fastener 12 in an unauthorized manner, such as by prying up on the fastener with the screwdriver 17, as shown in FIG. 6, the outer head 14 of the fastener 12 bends upwardly. However, this bending stresses the membrane 28 and causes it to shatter, thus releasing the liquid dye 18 so that if flows onto and stains the garment 10.

The shattering of the membrane 28 results from the fact that it is more brittle than the outer head 14 of the fastener 12. Thus when the screwdriver 17 is used to pry up on the outer head 14, the outer head bends at its periphery. This produces stresses on the membrane which, because of its brittle nature and the fact that it is sealed peripherally to the skirt 22, actually shatters in response to the bending of the outer head 14.

In the preferred embodiment, the head 14 is made of high impact polystyrene or nylon and the membrane 28 is a molding grade acrylic material such as sold under the registered trademark PLEXIGLAS, grade MI-7, by Rohm & Haas Co. of Philadelphia, Pennsylvania.

In the embodiment of FIGS. 5 and 6, the head 14 is about 1.812 inches (4.6 cm) in diameter and has a thickness of about 0.060 inches (15 mm) throughout most of its extent, except that where it joins the skirt 22 there is formed a recess 60 and the skirt 22 widens out from the recess. The recess serves to accommodate a metal ring (not shown which may optionally be positioned in the head to provide greater resistance to cutting). The skirt 22 has a flat bottom surface 62 which defines a flat plane 64.

The hub 24 in the embodiment of FIGS. 5 and 6 has a diameter of about 0.250 inches (0.635 cm) and it extends down inside the head 14 to a distance about half way to the plane defined by the bottom of the skirt 22. The hub 22 has an axial through bore 66 which extends perpendicular to the plane 64 defined by the skirt bottom surface 62. The bore 66 has a diameter of about 0.045 inches (11.4 mm) to accommodate the shank 32 of the pin 16. The counterbore 38 is about 0.096 inches (24.4 mm) diameter and extends down from the outer surface of the head 14 a distance of about 0.095 inches (24.1 mm) to accommodate the enlarged head 36 of the pin 16.

The ribs 26 are arranged to extend radially from the hub 24 at intervals of about 60 degrees. The bottoms of the ribs 26 are flush with the bottom of the hub 24 and extend parallel to the plane 64 defined by the bottom of the skirt 22 until they merge with the inner surface of the head. The ribs 26 are about 0.060 inches (15.2 mm) thick.

The membrane 28 is of uniform thickness i.e. about 0.22–0.025 inches (5.6–6.3 mm). It has been found that an acrylic material at this thickness will shatter readily under stress. Other materials may be used but their performance is not as good. For example, crystalline polystyrene is too sensitive for practical use although it will function to shatter under stress. High impact and medium impact polystyrene are too strong and require excessive stress to produce shattering. As to acrylics, the molding grade acrylics (not extrusion grade) are preferred because at the proper thickness they produce shattering under the stress that is experienced when the head 14 is pried with a forcing tool. Also, acrylics are easily welded to the head 14 by sonic welding techniques.

The membrane 28 is of dished configuration and has an outer peripheral flange 68 which is assembly lies flat against and is sonically welded to the bottom surface 62 of the skirt 22. The membrane 28 then slants inwardly to the bottom surface of the ribs 26 and then extends parallel to the plane 64 until it reaches the hub 24. The membrane hole 40 is concentric with the bore 66 in the hub so that the pin shank 32 can easily pass through the membrane. The membrane in turn is sonically welded to the bottom surface of the hub 22 around the bore 66.

In assembling the fastener 12, the head 14 after being formed by known molding techniques is fitted with the pin 16 which is forced down through the bore 66 until its enlarged head 36 rests at the bottom of the counterbore 38. The pin shank and head 32 and 36 are somewhat larger than the bore 66 and counterbore 38 of the head 14 so that the pin 16 is force fitted to the head. The pulling strength of the pin and head, however, is not obtained from this force fit but rather from the reaction of the enlarged head 36 on the bottom of the counterbore 38 when an attempt is made to force off the head.

After the pin 16 is fitted to the head 14 the head is turned so that it concave side faces upwardly, i.e. with the pointed end of the pin shank 32 also pointing upwardly.

The liquid dye 18 is then poured into the head 14. The dye may be any well known dye of any color that will stain a particular garment and render it unfit for use. Also, other fluid substances, for example an ill-smelling liquid may be used in place of the dye 18.

After the dye 18 has been poured into the concave side of the head 14, the membrane 28 is positioned onto the head 1 so that the pin shank 32 passes through the central hole 40 of the membrane and the outer flange 68 of the membrane rests on the bottom surface of the skirt 22 and the portion of the membrane around the hole 40 rests on the bottom of the hub 24. The membrane flange 22 is then sonically welded at its periphery to the skirt 22 and the portion of the membrane around the opening 40 is welded to the hub 24. This seals the dye 18 inside the hollow enclosure defined by the membrane and the head.

The thus assembled fastener may then be used to attach an object, such as the target wafer 20 to a garment. When the peripheral skirt of the fastener head 14 is forced upwardly, as by a prying tool, the resulting stress produced on the membrane 28 will cause it to shatter and release the dye 18 onto the garment. However, when the target wafer 20 is subjected to a properly applied magnetic decoupling force, its locking mechanism will release the pin 16 and the fastener may be easily and safely removed without any stress imposed on the membrane 28.

Figure 7:
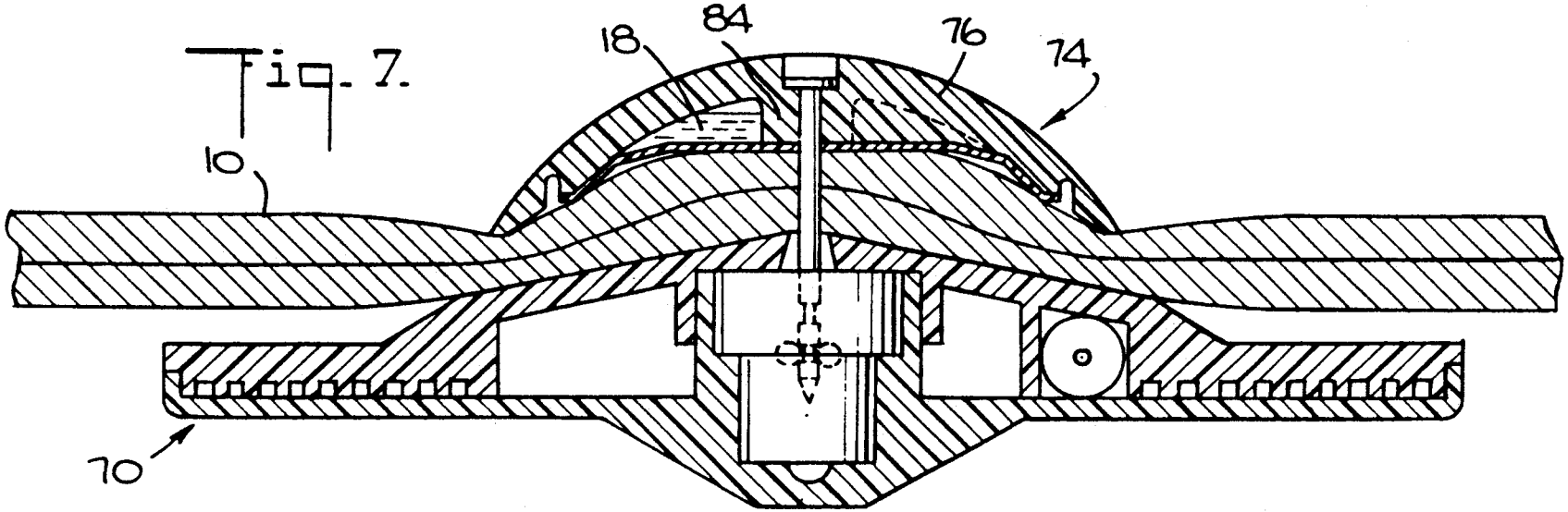
FIG. 7 is a view similar to FIG. 5 but showing an alternate form of the fastener and wafer.
Figure 8:
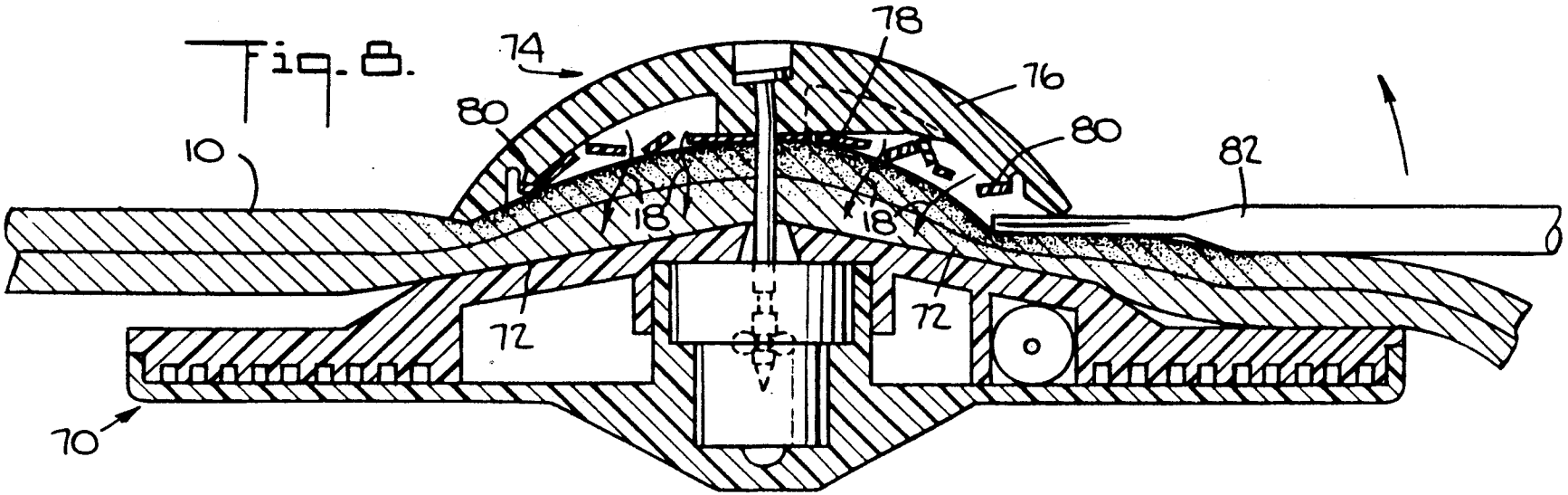
FIG. 8 is a view similar to FIG. 7 but showing the effect of an unauthorized removal of the fastener.

The embodiment of FIG. 7 and 8 is basically the same as that of FIGS. 5 and 6 except that this embodiment is designed to be used with a target wafer 70 which does not have a circular rounded ridge but instead as a gently upwardly sloping upper surface 72. In this embodiment there is provided fastener 74 having a head 76 of similar construction to that of the head 14 of the previous embodiment except that the head 76 is more rounded and cup shaped, thus providing a greater concavity in its bottom surface. In addition, the embodiment of FIGS. 7 and 8 has a membrane 78 similar to the membrane 28 of the previous embodiment except that instead of being sealed to the outer bottom wall of the head skirt, it is sealed to a bottom wall 80 of the head 14 formed inside the skirt. As shown in FIG. 8, when a tool 82 is forced under the periphery of the head 76, it causes the head to bend upwardly and stress the membrane 78, causing it to shatter and release dye 18 which was sealed between the membrane and the bottom of a hub 84 formed inside the head 76.

Figure 9:
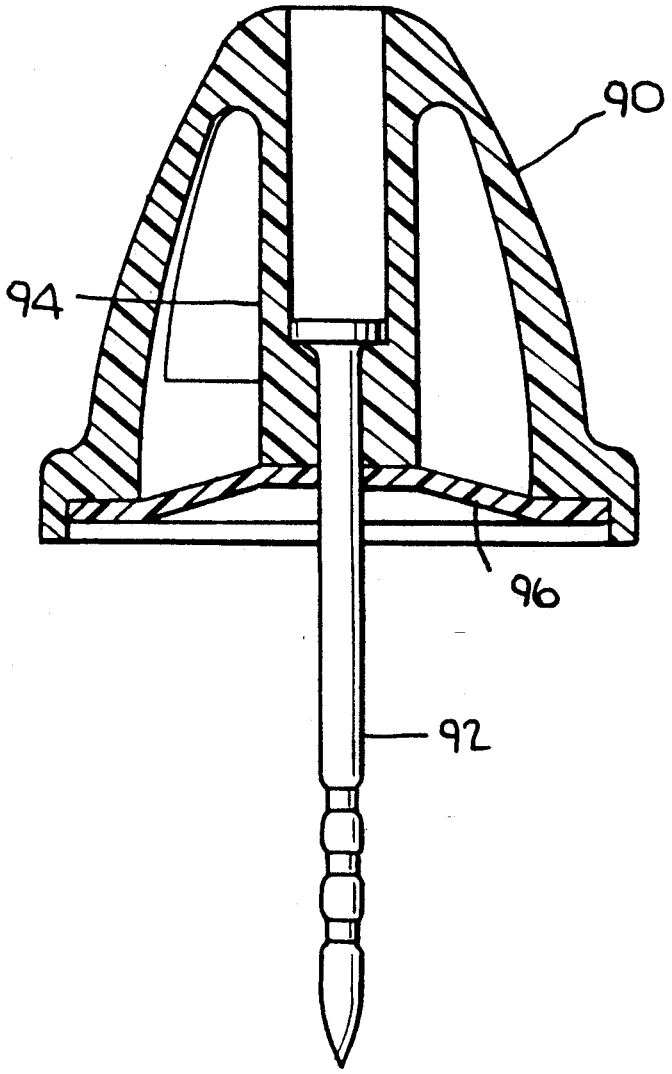
FIG. 9 is a section view of a still further form of a fastener according to the present invention.

The embodiment of FIG. 9 is similar in overall construction to that of the preceding embodiments in that it comprises as outer head 90 of molded plastic such as crystalline polystyrene with a headed pin 92 filtered into a bore and counterbore in a central hub 94 molded into the head, and a membrane 96 of a shatterable acrylic material sealed to the hub and skirt portion of the head to contain a liquid dye. In this embodiment the head 90 is higher and or smaller diameter than those of the proceeding embodiments. However in this embodiment, the hub 94 extends nearly to the plane of the bottom of the skirt so that the membrane 96 is nearly flat. Thus although the shape of the head 90 is such that more force is required to bend it then is required in the preceding embodiments, less bending is required to stress and shatter the membrane 96. It will be appreciated that in each of the embodiments disclosed herein there is provided a simple uncomplicated structure of few parts which is easy to assemble and which at the same time provides safe authorized operation and is nevertheless reliably responsive to tampering to release a dye or other undesirable substance and destroy the utility of the garment being protected.

We claim:

1. A fastener for attaching an element to a sheet-like object in a manner which will discourage unauthorized removal of said element, said fastener comprising:

an expansive head of molded plastic material and formed in a dished configuration with an outer peripheral skirt surrounding a central axial hub and said skirt being spaced from the hub to form a hollow region therebetween;

a pine extending through said hub along a line substantially perpendicular to a plane defined by the edge of said skirt and extending from the skirt edge side of the head;

a fluid substance capable of producing an undesirable effect upon release from containment and being contained in said hollow region; and a frangible membrane extending between said hub and said skirt and sealed to said hub and skirt to contain said fluid substance, whereby a prying force or the edge or said head which causes it to bend will impose a stress on said membrane, causing it to shatter and release fluid substance.

2. A fastener according to claim 1 wherein said membrane is sonically welded to said hub and to said head at said skirt.

3. A fastener according to claim 1 wherein said head is formed with ribs which extend across aid hollow region from said hub toward said skirt.

4. A fastener according to claim 1 wherein said membrane is of an acrylic material.

5. A fastener according to claim 4 wherein said head is of crystalline polystyrene.

6. A fastener according to claim 1, wherein said head is of integral one-piece construction with said skirt and said hub joined to each other.

7. A fastener according to claim 6 wherein said hub is formed with an axial opening which extends therethrough to accommodate said pin.

8. A fastener according to claim 6 wherein said pin has an integral enlarged head and wherein said axial opening in said hub is countersunk to accommodate said enlarged head within said hub.

9. A fastener assembly comprising a fastener and an object arranged on opposite sides of an article;

said fastener having an expansive head of a molded plastic material and formed in a dished configuration with an outer peripheral skirt surrounding a central axial hub and said skirt being spaced from said hub to form a hollow region therebetween;

a pin extending through said hub along a line substantially perpendicular to a plane defined by the edge of said skirt and extending from the skirt edge side of the head;

a fluid substance capable of producing an undesirable effect upon release from containment and being contained in said hollow region; and a frangible membrane extending between said hub and said skirt and sealed to said hub and skirt to contain said fluid substance;

whereby a prying force on the edge of said head which causes it to bend will impose a stress on said membrane, causing it to shatter and release said fluid substance;

said pin extending through said article and extending into said object;

said object having a pin shank locking mechanism therein which receives and holds said pin tightly and releases said pin without stress on said head in response to an authorized force applied to said object.

10. A fastener assembly according to claim 9, wherein said head is of integral one-piece construction with said skirt and said hub joined to each other.

11. A fastener according to claim 10 wherein said hub is formed with an axial opening which extends therethrough to accommodates said pin.

12. A fastener according to claim 10 wherein said pin has an integral enlarged head and wherein said axial opening in said hub is countersunk to accommodate said enlarged head within said hub.

13. A fastener according to claim 9 wherein said membrane is sonically welded to said hub and to said head at said skirt.

14. A fastener according to claim 9 wherein said head is formed with ribs which extend across said hollow region from said hub toward said skirt.

15. A fastener according to claim 9 wherein said membrane is of an acrylic material.

16. A fastener according to claim 6 wherein said head is of crystalline polystyrene.

* * * * *

UNITED STATES PATENT AND TRADEMARK OFFICE

CERTIFICATE OF CORRECTION

PATENT NO. : 5,088,165

DATED : February 18, 1992

INVENTOR(S) : ARTHUR J. MINASY, ET AL.

It is certified that error appears in the above-identified patent and that said Letters Patent is hereby corrected as shown below:

COLUMN 2

Line 15, "but" should read --hub--.

COLUMN 3

Line 31, "and" should read --and is--.
Line 47, "fasteners." should read --fastener.--.

COLUMN 4

Line 14, "sales person" should read --salesperson--.
Line 24, "if" should read --it--.
Line 28, "on" should be deleted.
Line 40, "inches" should read --inch--.
Line 50, "inches" should read --inch--.
Line 51, "half" should read --half- --.
Line 53, "hub 22" should read --hub 24--.
Line 56, "inches" should read --inch--.
Line 57, "inches" should read --inch--.
Line 59, "inches" should read --inch--.
Line 67, "inches" should read --inch--.

COLUMN 5

Line 2, "inches" should read --inch--.
Line 17, "is" should read --in--.
Line 38, "it" should read --its--.
Line 48, "head 1" should read --head 14--.
Line 53, "22" should read --68--.

UNITED STATES PATENT AND TRADEMARK OFFICE

CERTIFICATE OF CORRECTION

PATENT NO. : 5,088,165

DATED : February 18, 1992

INVENTOR(S) : ARTHUR J. MINASY, ET AL.

It is certified that error appears in the above-identified patent and that said Letters Patent is hereby corrected as shown below:

COLUMN 6

Line 4, "as" should read --has--.
Line 14, "head 14" should read --head 76--.
Line 24, "as" should read --an--.
Line 30, "smaller" should read --smaller in--.
Line 35, "then" should read --than--.
Line 55, "pine" should read --pin--.
Line 65, "or" (first occurrence) should read --at--.

COLUMN 7

Line 5, "aid" should read --said--.

COLUMN 8

Line 20, "accommodates" should read --accommodate--.
Line 33, "claim 6" should read --claim 9--.

Signed and Sealed this

Third Day of August, 1993

*Attest:*

Michael K. Kirk

MICHAEL K. KIRK

*Attesting Officer*

*Acting Commissioner of Patents and Trademarks*